US009837731B2

(12) United States Patent
Li et al.

(10) Patent No.: US 9,837,731 B2
(45) Date of Patent: Dec. 5, 2017

(54) FIELD INSTALLABLE CONNECTOR

(71) Applicant: Tyco Electronics (Shanghai) Co. Ltd., Shanghai (CN)

(72) Inventors: Hua Li, Shanghai (CN); Guangming Zhao, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 15/291,144

(22) Filed: Oct. 12, 2016

(65) Prior Publication Data

US 2017/0104278 A1 Apr. 13, 2017

(30) Foreign Application Priority Data

Oct. 12, 2015 (CN) ..... 2015 2 0787998 U

(51) Int. Cl.

| | |
|---|---|
| ***H01R 4/48*** | (2006.01) |
| ***H01R 13/04*** | (2006.01) |
| ***H01R 13/688*** | (2011.01) |
| ***H01R 24/20*** | (2011.01) |
| *H01R 103/00* | (2006.01) |

(52) U.S. Cl.

CPC ..... *H01R 4/489* (2013.01); *H01R 4/48* (2013.01); *H01R 4/4818* (2013.01); *H01R 13/04* (2013.01); *H01R 13/688* (2013.01); *H01R 24/20* (2013.01); *H01R 2103/00* (2013.01)

(58) Field of Classification Search

CPC ..... H01R 4/48; H01R 4/489; H01R 4/4818; H01R 4/4827; H01R 4/4836; H01R 4/4845; H01R 9/245; H01R 13/04; H01R 13/688; H01R 24/20; H01R 2103/00

USPC ..... 439/620.29, 441, 725, 729, 822, 829, 439/834, 835, 838

See application file for complete search history.

(56) References Cited

U.S. PATENT DOCUMENTS

| | | | | |
|---|---|---|---|---|
| 5,816,858 A * | 10/1998 | Kazarian | H01H 85/2045 | 439/366 |
| 6,162,097 A * | 12/2000 | Liang | H01H 85/202 | 439/218 |
| 6,406,331 B1 * | 6/2002 | Brown | H01R 13/639 | 439/620.33 |
| 6,689,955 B2 * | 2/2004 | Doutaz | H01R 4/4836 | 174/135 |
| 7,510,448 B2 * | 3/2009 | Eppe | H01R 4/4836 | 439/729 |
| 7,887,372 B2 * | 2/2011 | Lee | H01H 85/0208 | 439/620.34 |
| 8,129,641 B2 * | 3/2012 | Majewski | H01R 4/4836 | 200/335 |
| 8,475,191 B2 * | 7/2013 | Schafmeister | H01R 4/4836 | 439/266 |

(Continued)

*Primary Examiner* — Tulsidas C Patel
*Assistant Examiner* — Travis Chambers
(74) *Attorney, Agent, or Firm* — Barley Snyder

(57) ABSTRACT

A connector is disclosed. The connector comprises a housing having an insertion passageway, an operating lever having an end pivotably connected to the housing, and a spring having a first end fixed to the operating lever and an opposite second end extending into an interior of the connector. The operating lever is movable between an open position and a closed position. The second end of the spring closes the insertion passageway when the operating lever is in the closed position.

20 Claims, 5 Drawing Sheets

(56) References Cited

U.S. PATENT DOCUMENTS

| | | | | |
|---|---|---|---|---|
| 8,480,424 | B2 * | 7/2013 | Koellmann | H01R 4/4845<br>439/358 |
| 9,548,176 | B2 * | 1/2017 | McEvilly | H01H 85/22 |
| 2011/0318972 | A1 * | 12/2011 | Koellmann | H01R 4/4845<br>439/729 |
| 2015/0162671 | A1 * | 6/2015 | Hoppmann | H01R 4/4854<br>439/370 |

* cited by examiner

FIELD INSTALLABLE CONNECTOR

CROSS-REFERENCE TO RELATED APPLICATIONS

This application claims the benefit of the filing date under 35 U.S.C. §119(a)-(d) of Chinese Patent Application No. 201520787998.4, filed on Oct. 12, 2015.

FIELD OF THE INVENTION

The invention relates to a connector, and more particularly, to a field installable connector.

BACKGROUND

As is known in the art, electrical connectors are used to connect two electrical components to transmit or provide an electrical power connection or a communication connection between them. Generally, at the time a product leaves a factory, various electrical components are already connected with each other through a connector. Sometimes, however, the connector needs to be installed in-situ, for example, during maintenance or other situations where a field installation is needed. In known field installable connectors, a relatively large force must be applied to the field installable connector or a tool may be required to connect or detach a cable and a metal terminal via the connector.

SUMMARY

An object of the invention, among others, is to provide a connector that can be wired on site easily and without a tool. The disclosed connector comprises a housing having an insertion passageway, an operating lever having an end pivotably connected to the housing, and a spring having a first end fixed to the operating lever and an opposite second end extending into an interior of the connector. The operating lever is movable between an open position and a closed position. The second end of the spring closes the insertion passageway when the operating lever is in the closed position.

BRIEF DESCRIPTION OF THE DRAWINGS

The invention will now be described by way of example with reference to the accompanying figures, of which.

DETAILED DESCRIPTION OF THE EMBODIMENT(S)

The invention is explained in greater detail below with reference to embodiments of a connector. This invention may, however, be embodied in many different forms and should not be construed as limited to the embodiments set forth herein; rather, these embodiments are provided so that this disclosure will be thorough and complete and still fully convey the scope of the invention to those skilled in the art.

Figure 1:
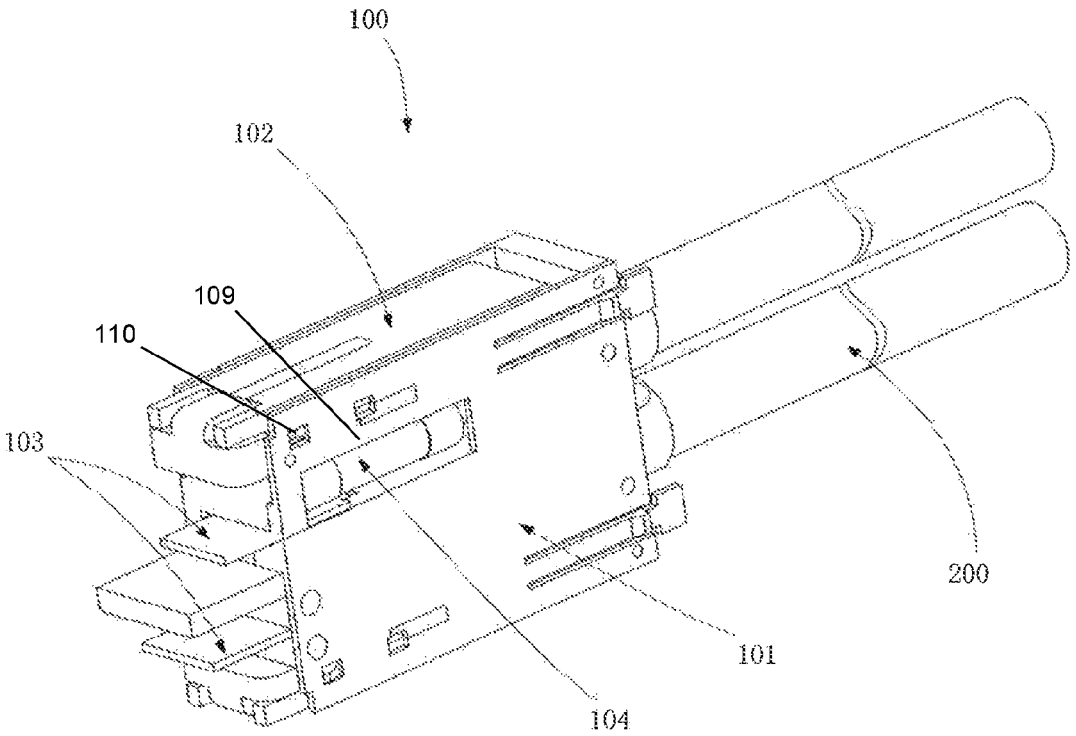
FIG. 1 is a perspective view of a connector according to the invention connected to a cable.
Figure 2:
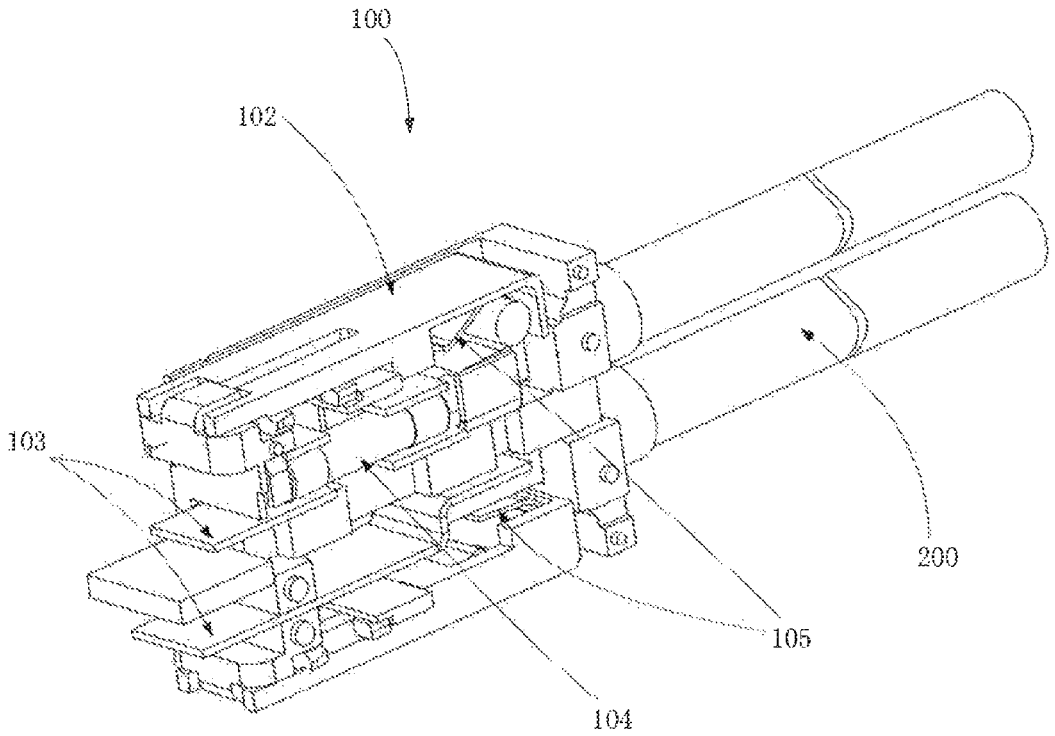
FIG. 2 is a perspective view of the connector of FIG. 1 with part of a housing removed.
Figure 3:
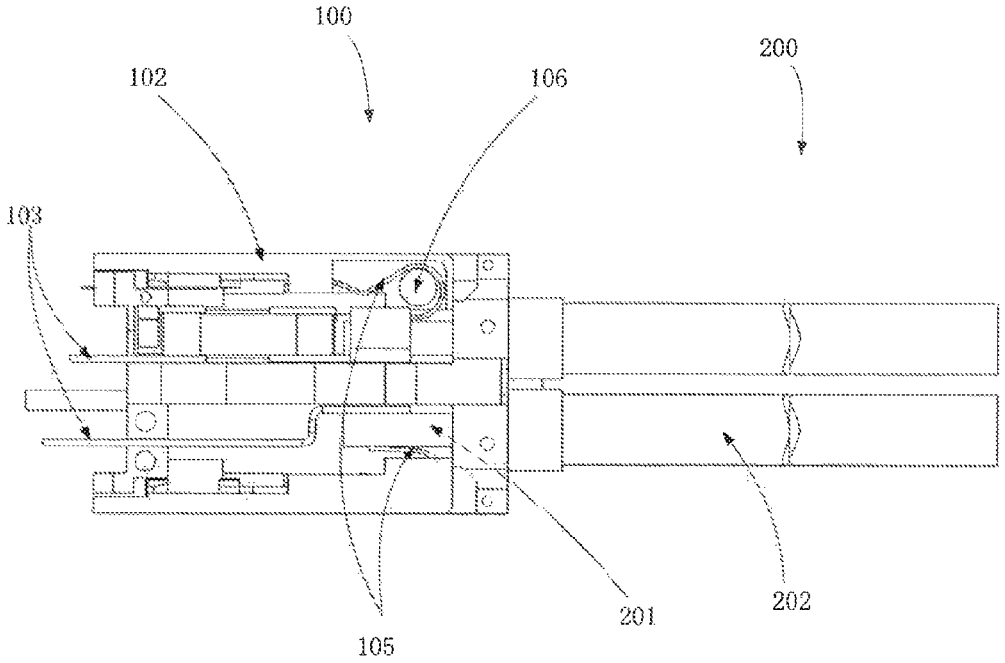
FIG. 3 is a side view of the connector of FIG. 2.
Figure 4:
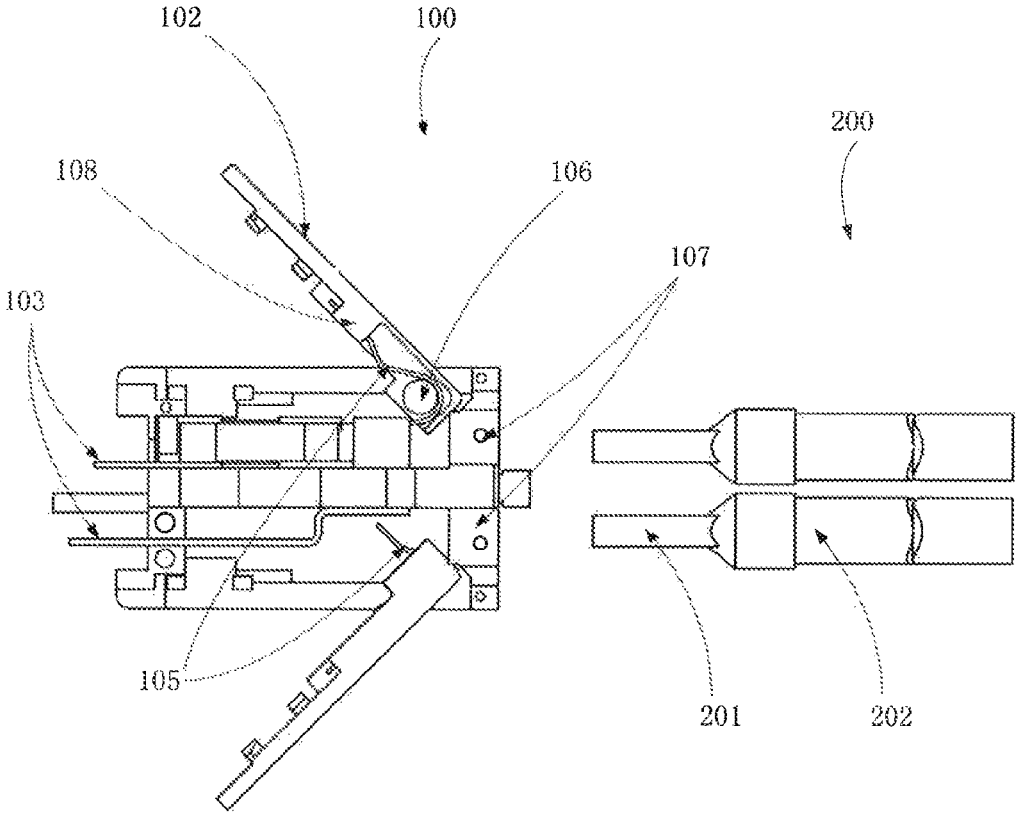
FIG. 4 is a side view of the connector of FIG. 2 with an operating lever in an open position.

A connector 100 according to the invention is shown in FIGS. 1-5. As shown in FIGS. 1, 2, and 4, the connector 100 includes a housing 101, an operating lever 102, a contact tongue 103, a fuse 104, a spring 105, and a post 106. The major components of the invention will now be described in greater detail.

Figure 5:
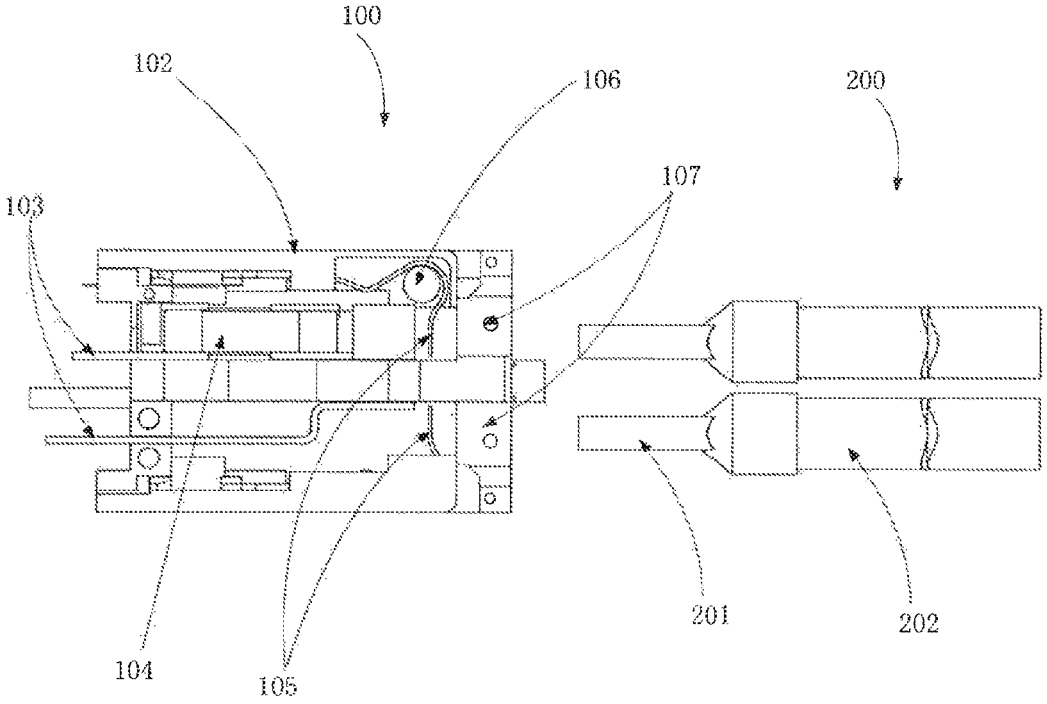
FIG. 5 is a side view of the connector of FIG. 2 with an operating lever in a closed position.

The housing 101 is shown in FIG. 1. In the shown embodiment, the housing 101 is a rectangular prism, but the housing 101 may be any other shape capable of containing the described components. The housing 101 has an insertion passageway 107, as shown in FIGS. 4 and 5, extending through a rear end of the housing 101. As shown in FIGS. 4 and 5, the housing 101 may include a plurality of insertion passageways 107.

The operating lever 102, as shown in FIGS. 2 and 3, is disposed at an upper portion of the connector 100. As also shown in FIGS. 1-3, the connector 100 may include a plurality of operating levers 102, with one operating lever 102 disposed at an upper portion of the connector 100 and one operating lever 102 disposed at a lower portion of the connector 100. The operating lever 102, as shown in FIG. 4, has a mounting portion 108. The mounting portion 108 may comprise a hole, a slot, a long and narrow passage or other features.

The contact tongue 103, as shown in FIGS. 1-5, has a first portion disposed within the housing 101 and a second portion extending out from a front end of the housing 101.

The fuse 104, shown in FIGS. 1-3, may be any type of fuse known to those with ordinary skill in the art. The fuse 104 is mounted within the housing 101. A fuse mounting hole 109, as shown in FIG. 1, may be provided in a first side of the housing 101 such that the fuse 104 may be mounted within the connector 100 without disassembling the connector 100; a size of the fuse mounting hole 109 is comparable with a size of the fuse 104. In an embodiment, an opposite second side of the housing 101 may be provided with a fuse removing hole (not shown). The fuse removing hole may be much smaller than the fuse mounting hole 109, such that the fuse 104 may be pushed out from the fuse mounting hole 109 simply by inserting a suitable tool into the fuse removing hole when it needs to be removed or replaced. In other embodiments, the fuse 104 may not be provided.

The spring 105 and post 106 are shown in FIGS. 3-5. The spring 105 may be any type of spring known to those with ordinary skill in the art, including a leaf spring. The spring 105 may be formed of a metal material having a sufficient rigidity. The post 106 is positioned within the housing 101 and extends transversely with respect to the housing 101. As shown in FIGS. 3-5, the connector 100 may include a plurality of springs 105 and a plurality of posts 106.

The spring 105 is mounted at an inner side of the operating lever 102, and a central portion of the spring 105 is disposed around the post 106. A first end of the spring 105 is fixed to the operating lever 102 at the mounting portion 108, which holds or clamps the first end of the spring 105, so as to move along with action of the operating lever 102. An opposite second end of the spring 105, as shown in FIG. 4, extends into an interior of the connector 100; the spring 105 extends around an outer side of the post 106 and bends in a different direction toward the second end of the spring 105. In an alternative embodiment, a passage (not shown) may be formed in the operating lever 102 to hold or clamp the first end of the spring 105, while the second end of the spring 105 may extend out of the passage towards the inside of the connector 100. The spring 105 bends along with the passage toward the second end of the spring 105.

The operating lever 102 is pivotably connected to the post 106, which may be fixed to the housing 101. In an alternative embodiment, the post 106 may be formed on an end of the operating lever 102, and the operating lever 102 may be pivotably coupled to the housing 101 at the post 106. For example, a blind hole (not shown) may be formed at a back side of the post 106, and the operating lever 102 and post 106 may be pivotably coupled to a protrusion formed on the housing 101 via the blind hole The connector 100, as shown in FIGS. 1-5, may be connected to an electrical cable 200. As would be understood by one with ordinary skill in the art, the connector 100 may alternatively connect to network cables or other signal cables.

The cable 200, as shown in FIGS. 3-5, has an end 201 and a body 202. The body 202 may be connected to a power source or other electrical components (not shown). As in the shown embodiment, the connector 100 may also be connected to a plurality of electrical cables 200.

The operating lever 102 has a closed position, shown in FIGS. 1-3 and 5, and an open position, shown in FIG. 4.

When the connector 100 is not in use, the operating lever 102 may be fixed in the closed position shown in FIG. 5. The housing 101 may be provided with a fixing device 110 for holding the operating lever 102 in the closed position. The fixing device 110, for example, may comprise a snap-fit structure for fixing the left end of the operating lever 102. In the closed position, the insertion passageway 107 is closed by the second end of the spring 105. Due to the position and rigidity of the second end of the spring 105 in the closed position, the end of the cable 200 cannot be inserted into the insertion passageway 107 easily, and foreign substances such as dusts and the like may be prevented from entering the inside of the connector 100 when the connector 100 is not in use.

When the connector 100 is to be used, the operating lever 102 is released from the fixing device 110, and then the operating lever 102 is pulled manually to the open position shown in FIG. 4. The second end of the spring 105 is pivoted away from the insertion passageway 107 by motion of the operating lever 102. The insertion passageway 107 is opened in the open position, such that the end 201 of the cable 200 may be inserted into the connector 100 via the insertion passageway 107. Alternatively, the end of the cable 200 may be directly inserted into the insertion passageway 107 when the operating lever 102 is released from the fixing device 110. In this case, during the insertion into the insertion passageway 107, the end 201 of the cable 200 abuts against and pushes the second end of the spring 105 inwards, so as to drive the operating lever 102 to be pivoted to the opened position.

After the end 201 of the cable 200 has been inserted into the insertion passageway 107, the end 201 contacts the first portion of the contact tongue 103, as shown in FIG. 3, forming an electrical connection between the connector 100 and the cable 200. Thus, when the second portion of the contact tongue 103 is connected to another electrical component (not shown), the electrical component is electrically connected to the cable 200.

When the end 201 of the cable 200 is inserted into the insertion passageway 107, the operating lever 102 may be pivoted manually back to the above described closed position shown in FIG. 3. In this state, since the end 201 of the electric cable 200 has been inserted into the inside of the connector 100, the second end of the spring 105 cannot be restored to its original position to close the insertion passageway 107, and instead, the second end of the spring 105 abuts against and presses on a side of the end 201 of the cable 200. Since the spring 105 applies a pressure force on the side of the end 201 of the cable 200, the end 201 is thereby firmly held within the connector 100, such that the electric cable 200 is prevented from separating from the connector 100.

Advantageously, in the connector 100 according to the invention, replacement of the cable 200 may be achieved rapidly through manually operating the operating lever 102 without using a tool to disassemble the connector 100. Furthermore, when the connector 100 is not in use, foreign substances can be prevented from entering the connector 100. Additionally, the cable 200 can be properly fixed, such that it cannot be separated from the connector 100 easily, and the fuse 104 may also be replaced rapidly without disassembling the connector 100.

What is claimed is:

1. A connector, comprising:

a housing having an insertion passageway;

an operating lever having an end pivotably connected to a post positioned within the housing, the operating lever movable between an open position and a closed position; and a spring having a first end fixed to the operating lever, an opposite second end extending into an interior of the connector, and a central portion disposed around the post, the second end of the spring closing the insertion passageway when the operating lever is in the closed position and positioned away from the insertion passageway such that a cable is insertable into the insertion passageway when the operating lever is in the open position.

2. The connector of claim 1, wherein the housing has a fixing device holding the operating lever in the closed position.

3. The connector of claim 1, wherein the spring has a sufficient rigidity to prevent insertion of the cable when the operating lever is in the closed position.

4. The connector of claim 1, wherein, when the cable is inserted into the insertion passageway and the operating lever is moved from the open position to the closed position, the second end of the spring abuts and holds the cable.

5. The connector of claim 1, wherein the spring extends around an outer side of the post and bends in a different direction toward the second end of the spring.

6. The connector of claim 1, further comprising a contact tongue having a first portion disposed within the housing and a second portion extending out of the housing.

7. The connector of claim 6, wherein the second portion of the contact tongue is connected to an electrical device.

8. The connector of claim 1, further comprising a fuse disposed within the housing.

9. The connector of claim 8, wherein a first side of the housing has a mounting hole for mounting the fuse.

10. The connector of claim 9, wherein an opposite second side of the housing has a fuse removing hole for removing the fuse.

11. The connector of claim 1, wherein the first end of the spring is fixed within a passage of the operating lever.

12. The connector of claim 11, wherein the spring bends along the passage toward the second end of the spring.

13. A connector, comprising:

a housing having an insertion passageway, a mounting hole in a first side of the housing, and a fuse removing hole in an opposite second side of the housing;

an operating lever having an end pivotably connected to the housing, the operating lever movable between an open position and a closed position;

a spring having a first end fixed to the operating lever and an opposite second end extending into an interior of the connector, the second end of the spring closing the insertion passageway when the operating lever is in the closed position and positioned away from the insertion passageway such that a cable is insertable into the insertion passageway when the operating lever is in the open position; and a fuse mounted within the mounting hole and removable via the fuse removing hole.

14. The connector of claim 13, wherein the spring has a sufficient rigidity to prevent insertion of the cable when the operating lever is in the closed position.

15. The connector of claim 13, wherein, when the cable is inserted into the insertion passageway and the operating lever is moved from the open position to the closed position, the second end of the spring abuts and holds the cable.

16. The connector of claim 13, wherein the housing has a fixing device holding the operating lever in the closed position.

17. The connector of claim 13, further comprising a contact tongue having a first portion disposed within the housing and a second portion extending out of the housing.

18. The connector of claim 17, wherein the second portion of the contact tongue is connected to an electrical device.

19. The connector of claim 13, wherein the first end of the spring is fixed within a passage of the operating lever.

20. The connector of claim 19, wherein the spring bends along the passage toward the second end of the spring.

* * * * *